US005299605A

United States Patent [19]

Bergamini et al.

[11] Patent Number: 5,299,605

[45] Date of Patent: Apr. 5, 1994

[54] VAPOUR RECOVERY SYSTEM FOR A FUEL FILLING INSTALLATION

[75] Inventors: Giorgio Bergamini; Ernesto Paris, both of Bari, Italy

[73] Assignee: Nuovopignone-Industrie Meccaniche e Fonderia SpA, Florence, Italy

[21] Appl. No.: 888,560

[22] Filed: May 22, 1992

[30] Foreign Application Priority Data

May 24, 1991 [IT] Italy ..... MI91 A 001440

[51] Int. Cl.[5] ..... B67D 5/04; B65B 3/18

[52] U.S. Cl. ..... 141/59; 141/44; 141/46; 141/301; 141/286; 137/587; 165/179; 95/92

[58] Field of Search ..... 141/44–46, 141/59, 301, 286; 137/587; 55/387, 88; 165/179

[56] References Cited

U.S. PATENT DOCUMENTS

| | | | |
|---|---|---|---|
| 2,946,475 | 7/1960 | Rockelman | 137/587 |
| 3,508,608 | 4/1970 | Roe | 165/179 |
| 3,791,422 | 2/1974 | Johnson et al. | 141/11 |
| 3,881,894 | 5/1975 | Onufer | 55/88 |
| 3,926,230 | 12/1975 | Stary et al. | 141/45 |
| 3,941,168 | 3/1976 | Hiller et al. | 141/46 |
| 4,090,525 | 5/1978 | Potter | 137/587 X |
| 4,306,619 | 12/1981 | Trojani | 165/179 |
| 4,657,074 | 4/1987 | Tomita et al. | 165/179 |
| 5,038,838 | 8/1991 | Bergamini et al. | 141/59 |
| 5,040,577 | 8/1991 | Pope | 141/59 |
| 5,156,199 | 10/1992 | Hartsell, Jr. | 141/83 |

FOREIGN PATENT DOCUMENTS 2641267 7/1990 France .

*Primary Examiner*—Ernest G. Cusick
*Attorney, Agent, or Firm*—Morgan & Finnegan

[57] ABSTRACT

A vapor recovery system for a fuel filling installation in which the recovered air-vapor mixture is pumped to the submerged end of a discharge pipe. The discharge pipe is connected to a closed tube which extends along the bottom of an underground fuel tank. The closed tube has a porosity that generates very small bubbles from the air-vapor mixture that flows through the fuel within the tank. A vent pipe for the underground tank separates air from the air-vapor mixture through decreasing density separation by means of a large cross-section for the vent pipe and by providing baffles in the pipe interior.

10 Claims, 2 Drawing Sheets

VAPOUR RECOVERY SYSTEM FOR A FUEL FILLING INSTALLATION

BACKGROUND OF THE INVENTION

1. Field of the Invention

This invention relates to improvements in a vapor recovery system for a fuel filling installation which, by achieving more effective and quicker recondensation of the indrawn vapor both in the underground tank and in the vent pipe, and substantial decreasing-density separation of the air-vapor mixture within said vent pipe, allows effective and complete recovery of all the vapor present in the motor vehicle tank to be filled, without danger of explosion or undesirable pressurization of the underground tank and without using further vapor recondensation or separation units.

2. Description of the Related Art including information disclosed under 37 C.F.R. §§1.97–1.99.

More specifically, the present invention relates to improvements in the vapor recovery system of the preceding U.S. Pat. No. 5,038,838 granted Aug. 13, 1991 to Giorgio Bergamini and Ernesto Paris for "System For Safe Vapour Recovery, Particularly Suitable For Fuel Filling Installations".

In said applications, vapor recovery is achieved by using a delivery gun without members for sealing against the filler pipe of the vehicle tank to be filled, together with controlled draw-in of the arising vapor-air mixture by a variable speed positive displacement pump, the speed of which is continuously adjusted in accordance with the volumetric flow rate of the delivered fuel, such as to draw a volumetric quantity of the air-vapor mixture equal to the volumetric quantity of fuel delivered plus a possible air excess depending on the temperature of the underground tank and the vehicle tank to be filled, and of which the discharge pipe extends to the bottom of the underground tank so that the bubbling of the air-vapor mixture through the fuel in said tank results in the mixture temperature and hence its volume being rapidly adjusted to the temperature of the tank itself. In addition a costly recondensation unit is used for the excess vapor within the dome of the underground tank, this excess arising when the recovered vapor is at a lower temperature than the underground tank, this happening for example during winter periods.

This known arrangement allows effective open-system recovery of the air-vapor mixture as it continuously adapts the mixture flow rate to the volumetric flow rate of the delivered fuel and to the temperatures of said tanks. It is however not able to recover the excess vapor created in the vehicle tank by a certain "champagne" effect, which has never been taken into consideration in current recovery systems, and which is determined by the inevitable violent impact of the delivered fuel against the walls of the filler pipe and tank, and by its mixing with the residual fuel contained in the tank, this giving rise to numerous minute bubbles or foam, which by increasing the heat transfer area results in increased evaporation. This excess depends mainly on the fuel composition and temperature and on its delivery rate.

Experimental tests have shown that said bubbles or foam give rise to excessive evaporation, with a vapor production which can be as much as 40% more than the volume of the delivered fuel.

In this respect, with the system adjusted in the stated manner this vapor excess cannot be drawn in by the delivery gun so that it escapes to atmosphere via the filler pipe, whereas if said vapor excess were recovered by suitably increasing the capacity of the positive displacement pump, there would be an inevitable vapor loss to atmosphere through the underground tank vent.

DESCRIPTION OF THE PREFERRED EMBODIMENTS

Figure 1:
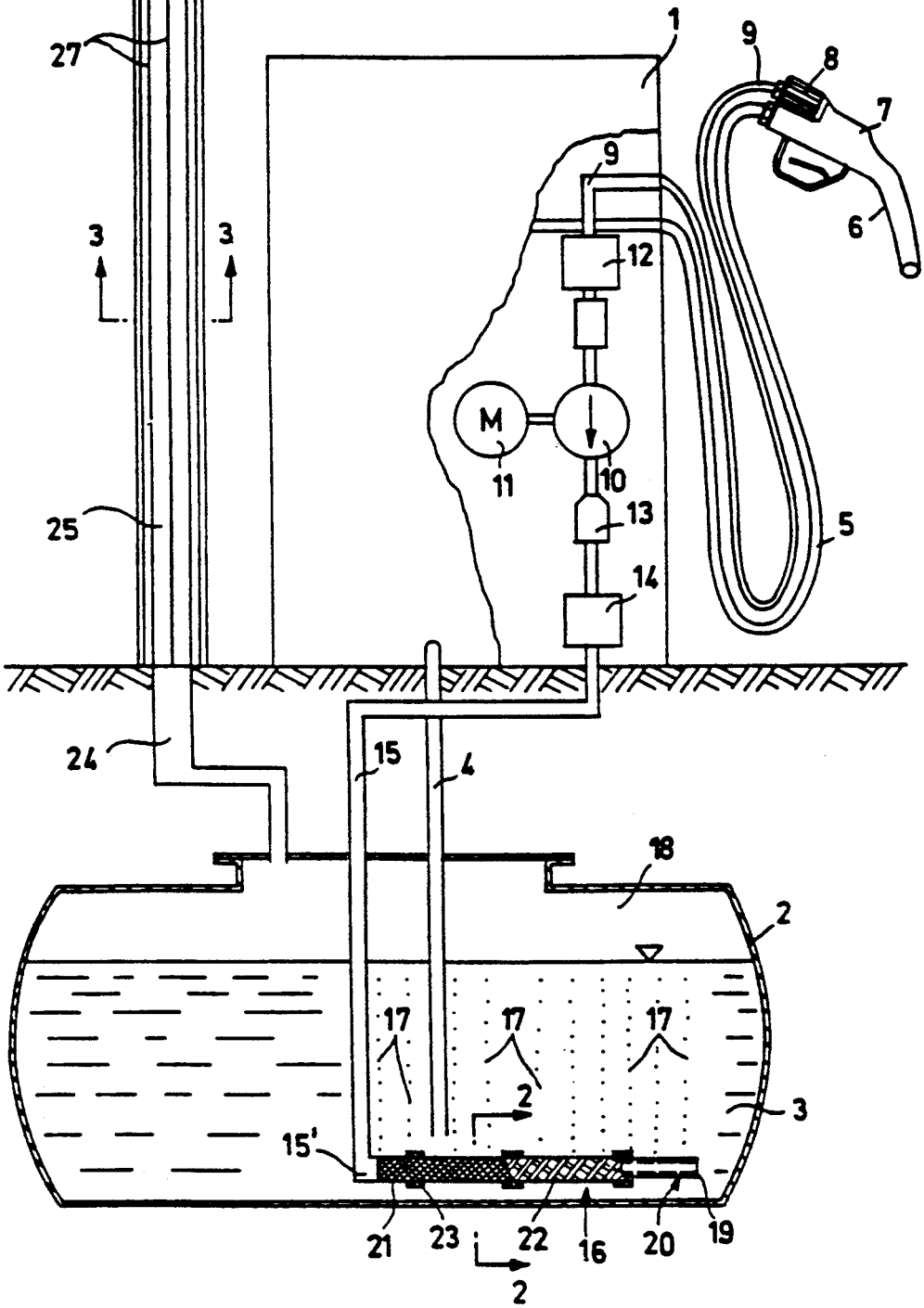
FIG. 1 is a schematic sectional view of a fuel filling installation using the improved vapor recovery system of the invention.
Figure 2:
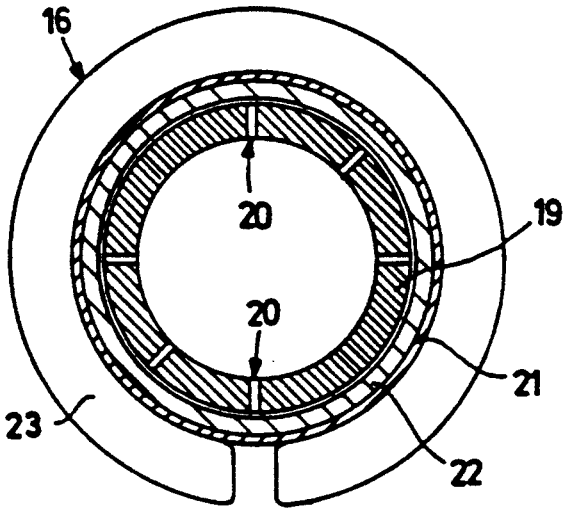
FIG. 2 is a cross-section on the line 2—2 of FIG. 1.
Figure 3:
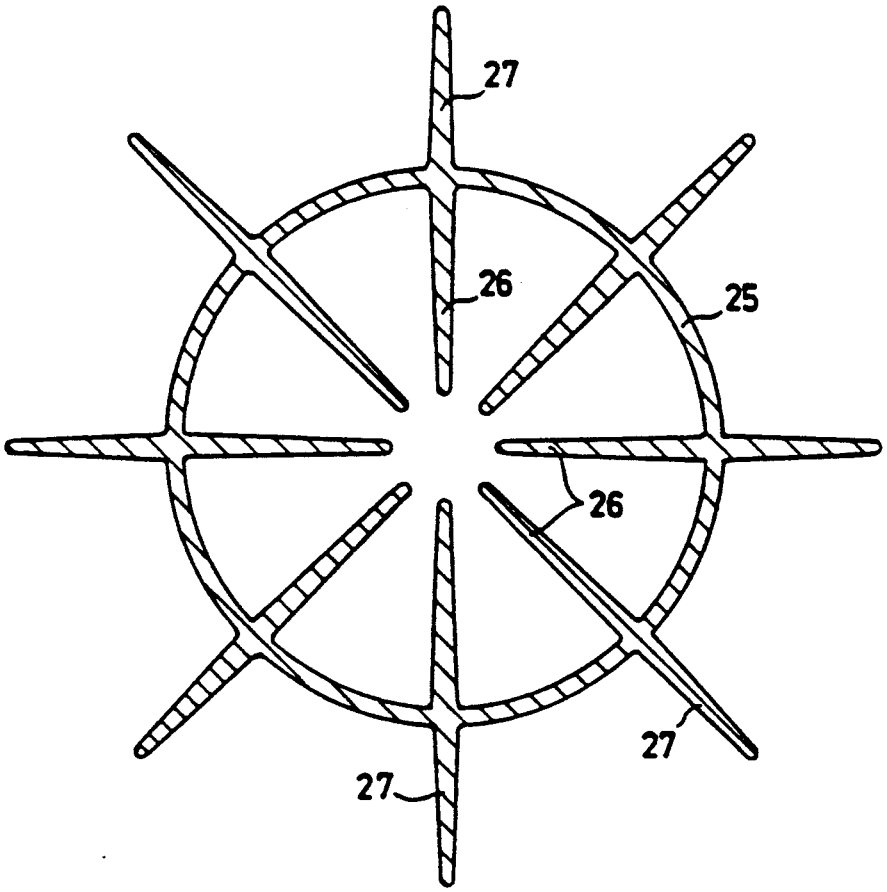
FIG. 3 is a cross-section on the line 3—3 of FIG. 1.

The object of the present invention is to obviate said drawback by providing a vapor recovery system for a fuel filling installation which always provides complete draw-in of all vapor at the delivery gun, even when maximum vapor excess is present by virtue of the "champagne" effect.

This object is substantially attained by increasing the delivery rate of the variable positive displacement pump beyond the effective delivery flow rate possibly temperature-corrected, by a further air-vapor mixture draw-in rate equal to the maximum possible "champagne" effect. To prevent this continuous greater pump intake pressurizing the underground tank or producing vapor discharge to atmosphere, vapor recondensation must be maximized while vapor is bubbling from the bottom of said underground tank. For this purpose, the end of the discharge pipe from the variable speed positive displacement pump, this end reaching the bottom of the underground tank of the fuel filling installation, is connected to a closed tube which extends along the bottom of said underground tank and has a porosity such as to generate very small bubbles.

In this manner, the high area/volume ratio of the very small bubbles bubbling through the porosity of said closed tube and hence the high heat transfer area between the vapor in the bubble and the liquid fuel in the underground tank ensures effective and reliable vapor recondensation, which is further facilitated by the greater time for which the bubble remains in the liquid fuel due to its decreased rate of upward movement.

Such an arrangement is perfectly suitable for recovering even a very large excess of vapor produced by the champagne effect, but does not solve the problem of drawing in any air excess additional to the quantity which should be in equilibrium in the underground tank, this occurring for example under particular temperature conditions such as the delivered fuel temperature being lower than that for which the fuel filling installation is set.

To solve this latter problem the vent pipe within the installation is modified, such that within which in addition to recondensing of the vapor from the air-vapor mixture, said mixture is also separated under decreasing density conditions so that the upper part of this pipe contains only air, it being this which is then discharged to atmosphere if the underground tank receives an excess of said mixture, so enabling further vapor recondensation or separation units to be dispensed with. Said decreasing-density separation is substantially achieved by optimizing the geometry of said vent pipe so as to achieve a slow and/or laminar flow of air-vapor mixture under all operating conditions, including the most unfavourable. This is done by reducing both the mixture speed by correspondingly increasing the pipe cross-section, and the so-called pipe hydraulic diameter by applying suitable baffles to the interior of the vent pipe.

To facilitate condensation of the mixture in the vent pipe by cooling it when the external temperature is less than the temperature within the pipe and hence less than the mixture temperature, the outside of the vent pipe is provided with heat dispersion fins.

Hence, the vapor recovery system for a fuel filling installation, comprising a pipe for returning the air-vapor mixture from the delivery gun inserted into the filler pipe of the motor vehicle tank to be filled, to the underground tank of the installation via an electric motor-driven variable speed positive displacement pump, the end of the discharge pipe of which extends to the bottom of said underground tank, and further comprising a vent pipe for said underground tank, is characterized according to the present invention in that the speed of said positive displacement pump is increased until it is able to draw in the entire amount of any excess vapor present at said filler pipe, said end of the discharge pipe being connected to a closed tube which extends along the bottom of said underground tank and has a porosity such as to generate very small bubbles, said vent pipe being formed of large cross-section and being provided with baffles in its interior.

According to a preferred embodiment of the present invention, said closed tube connected to said end of the positive displacement pump discharge pipe and which extends along the bottom of said underground tank and has a porosity such as to generate very small bubbles consists of a closed pipe provided with holes in its surface and covered with very densely woven metal or plastic netting or fabric, possibly with further wide-mesh fabric interposed to allow the air-vapor mixture to distribute over the entire surface of said densely woven covering netting or fabric, said tube possibly being weighted to prevent it floating, possibly by a series of lead sleeves arranged along its length.

Again, to facilitate the insertion of said closed tube into said underground tank without having to modify or empty the tank, according to a further preferred embodiment of the invention said closed tube is made of flexible material.

The invention is further clarified hereinafter with reference to the accompanying drawings which illustrate a preferred embodiment thereof provided by way of example only, in that technical or constructional modifications can be made thereto without leaving the scope of the present invention.

In the figures the reference numeral 1 indicates the pumping column of a fuel filling installation and 2 the underground tank of said installation, the fuel 3 of which, drawn through the feed pipe 4 by a pump, is conveyed through the delivery pipe 5 provided with a delivery gun 6. Said delivery gun 6 is also provided with a second rigid channel 7 for drawing-in and hence recovering the the air-vapor mixture from the filler pipe, not shown in the figures, of the vehicle tank to be filled, said channel being connected via a flame trap 8 to the return pipe 9, which conveys this mixture under the action of a variable speed positive displacement pump 10 driven by a motor 11 to the bottom of the underground tank 2 via a filter cartridge 12, a non-return valve 13, a further flame trap 14 and the discharge pipe 15. The submerged end 15' of said discharge pipe 15 is connected to a closed possibly flexible tube 16 extending along the bottom of the underground tank 2 and having a porosity such as to generate very small bubbles 17 of the recovered air-vapor mixture, these bubbling towards the dome 18 of the tank 2.

Said closed tube 16 consists of a closed pipe 19 provided with holes 20 in its surface and covered with very densely woven metal or plastic netting 21 by way of a layer of wide-mesh fabric 22. A series of weights, of heavy sleeves 23, for example of lead, maintain the flexible tube 16 on the bottom of the tank 2.

Finally, said dome 18 is connected via the connection pipe 24 to the vent pipe 25, which is formed of large cross-section with a diameter of the order of 2–3 times that of the vent pipes usually used, and is provided in its interior with baffles 26, heat dispersion fins 27 being provided on its outer surface.

We claim:

1. A vapor recovery system for recovering vapor from an air-vapor mixture for an automotive fuel filling installation having an underground fuel storage tank, comprising a delivery gun for insertion into the filler pipe of the automotive fuel tank, a discharge pipe, an end of which extends to the bottom of the underground tank for returning the air-vapor mixture from the tank to the underground fuel storage tank, an electric motor-driven variable speed positive displacement pump having a pump speed adequate to draw in all of the vapor present at the filler pipe, a vent pipe for the underground tank having a large cross-section and interior baffles, and a closed tube connected to said discharge pipe end, said closed tube extending along the bottom of the underground tank and said closed tube having a porosity for producing very small bubbles in order to recover vapor from the air-vapor mixture, said closed tube being connected to said discharge pipe end, said closed tube extending along the bottom of the underground tank and having a porosity for generating very small bubbles, said closed tube having holes in its surface, very densely woven netting covering said closed tube and large-mesh fabric interposed between said closed tube and said netting.

2. A vapor recovery system as claimed in claim 1, wherein said very densely woven netting further comprises a metal netting.

3. A vapor recovery system as claimed in claim 1, wherein said very densely woven netting further comprises a plastic material.

4. A vapor recovery system as claimed in claim 1 characterized in that said closed tube is provided along its length with a plurality of weights.

5. A vapor recovery system as claimed in claim 1 characterized in that said closed tube is formed of flexible material.

6. A vapor recovery system for recovering vapor from an air-vapor mixture for an automotive fuel filling installation having an underground fuel storage tank, comprising a delivery gun for insertion into the filler pipe of the automotive fuel tank, a discharge pipe, an end of which extends to the bottom of the underground tank for returning the air-vapor mixture from the tank to the underground fuel storage tank, an electric motor-driven variable speed positive displacement pump having a pump speed adequate to draw in all of the vapor present at the filler pipe, a vent pipe for the underground tank having a large cross-section and interior baffles, and a closed tube connected to said discharge pipe end, said closed tube extending along the bottom of the underground tank and said closed tube having a porosity for producing very small bubbles in order to recover vapor from the air-vapor mixture, a very densely woven fabric covering said closed tube, and further fabric of wide mesh interposed between said closed tube and said very densely woven fabric.

7. A vapor recovery system as claimed in claim 6 characterized in that said closed tube is provided along its length with a plurality of weights.

8. A vapor recovery system as claimed in claim 6 characterized in that said closed tube is formed of flexible material.

9. A vapor recovery system for recovering vapor from an air-vapor mixture for an automotive fuel filling installation having an underground fuel storage tank, comprising a delivery gun for insertion into the filler pipe of the automotive fuel tank, a discharge pipe, an end of which extends to the bottom of the underground tank for returning the air-vapor mixture from the tank to the underground fuel storage tank, an electric motor-driven variable speed positive displacement pump having a pump speed adequate to draw in all of the vapor present at the filler pipe, a vent pipe for the underground tank having a large cross-section and interior baffles, and a closed tube connected to said discharge pipe end, said closed tube extending along the bottom of the underground tank and said closed tube having a porosity for producing very small bubbles in order to recover vapor from the air-vapor mixture wherein said closed tube is provided along its length with a plurality of weights.

10. A vapor recovery system for recovering vapor from an air-vapor mixture for an automotive fuel filling installation having an underground fuel storage tank, comprising a delivery gun for insertion into the filler pipe of the automotive fuel tank, a discharge pipe, an end of which extends to the bottom of the underground tank, for returning the air-vapor mixture from the tank to the underground fuel storage tank, an electric motor-driven variable speed positive displacement pump having a pump speed adequate to draw in all of the vapor present at the filler pipe, a vent pipe for the underground tank having a large cross-section and interior baffles, a closed tube connected to said discharge end, said closed tube extending along the bottom of the underground tank and said closed tube having a porosity for producing very small bubbles in order to recover vapor from the air-vapor mixture wherein said vent pipe has heat dispersion fins on the outside thereof and in which said closed tube is provided along its length with a plurality of weights.

* * * * *